US005412006A

United States Patent [19]

Fisher et al.

[11] Patent Number: 5,412,006

[45] Date of Patent: May 2, 1995

[54] ELECTRORHEOLOGICAL CELS AND A METHOD FOR THE PREPARATION THEREOF

[75] Inventors: Mark D. Fisher; Mark H. Eckstein; Randall G. Schmidt, all of Midland, Mich.

[73] Assignee: Dow Corning Corporation, Midland, Mich.

[21] Appl. No.: 212,663

[22] Filed: Mar. 14, 1994

[51] Int. Cl.[6] ..... C08L 3/00

[52] U.S. Cl. ..... 524/47; 252/75; 524/200; 524/450; 524/724; 524/791; 525/100; 525/477

[58] Field of Search ..... 252/75; 524/47, 791, 524/724, 200, 450; 525/100, 477

[56] References Cited

U.S. PATENT DOCUMENTS

| | | | |
|---|---|---|---|
| 2,823,218 | 2/1958 | Speier | 260/448.2 |
| 3,159,601 | 12/1964 | Ashby | 260/46.5 |
| 3,159,662 | 12/1964 | Ashby | 260/448.2 |
| 3,220,972 | 11/1965 | Lamoreaux | 260/46.5 |
| 3,296,291 | 1/1967 | Chalk | 260/448.2 |
| 3,344,111 | 9/1967 | Chalk | 260/46.5 |
| 3,419,593 | 12/1968 | Willing | 260/448.2 |
| 3,445,420 | 5/1969 | Kookootsedes | 260/37 |
| 3,461,185 | 8/1969 | Brown | 260/825 |
| 3,516,946 | 6/1970 | Modic | 252/429 |
| 3,814,730 | 6/1974 | Karstedt | 260/46.5 |
| 3,882,083 | 5/1975 | Berger et al. | 260/46.5 |
| 3,928,629 | 12/1975 | Chandra et al. | 427/387 |
| 3,989,667 | 11/1976 | Lee et al. | 260/46.5 |
| 4,043,977 | 8/1977 | de Montigny et al. | 260/46.5 |
| 4,061,609 | 12/1977 | Bobear | 260/9 |
| 4,154,714 | 5/1979 | Hockemeyer et al. | 260/31.2 R |
| 4,256,870 | 3/1981 | Eckberg | 528/15 |
| 4,337,332 | 6/1982 | Melancon et al. | 528/15 |
| 4,347,346 | 8/1982 | Eckberg | 528/15 |
| 4,465,818 | 8/1984 | Shirahara et al. | 528/15 |
| 4,472,563 | 9/1984 | Chandra et al. | 528/15 |
| 4,476,166 | 10/1984 | Eckberg | 427/387 |
| 4,533,575 | 8/1985 | Melancon | 427/387 |
| 4,546,017 | 10/1985 | Flackett et al. | 427/387 |
| 4,562,096 | 12/1985 | Lo et al. | 427/208.8 |
| 4,645,614 | 2/1987 | Goosens et al. | 252/75 |
| 4,668,417 | 5/1987 | Goosens et al. | 252/75 |
| 4,774,111 | 9/1988 | Lo | 427/387 |
| 4,824,924 | 4/1989 | Letoffe et al. | 528/21 |
| 4,994,198 | 2/1991 | Chung | 252/78.3 |
| 5,162,460 | 11/1992 | Popa et al. | 525/478 |

OTHER PUBLICATIONS

Abstract: J04089893; Mar. 1992; A new electrorheological fluid consiting of silica particles dispersed in an electrically insulating medium contains 10–50 volume % of spherical silica particles prepared by hydrolyzing a silicon alkoxide in the presence of an alkali catalyst and drying at a temperature of up to 500 degrees centigrade.

Journal: Japanese Shiga et al., "Electroviscoelactic effect of polymeric composites consisting of polyelectrolyte particles and polymer gel" pp. 1293–1299.

Macromolecules 1993, 26, 6958–6963 "Electroviscoelastic Effect of Polymer Blends Consisting of Silicone Elastomer and Semiconducting Polymer Particles" Shiga, Okada and Kurachi.

*Primary Examiner*—Melvyn I. Marquis

*Attorney, Agent, or Firm*—Timothy J. Troy

[57] ABSTRACT

The present invention relates to an electrorheological gel comprising a curable silicone polymer, electrorheologically active particles, and a metal catalyst. The composition can further comprise an organohydrogensilicon crosslinking agent, and/or an inhibitor. The dynamic mechanical properties of the filled gel can be tuned with an electric field such that large changes in storage modulus can be achieved.

21 Claims, No Drawings

ELECTRORHEOLOGICAL CELS AND A METHOD FOR THE PREPARATION THEREOF

BACKGROUND OF THE INVENTION

The present invention relates to an electrorheological gel comprising a curable silicone polymer, electrorheologically active particles, and a metal catalyst which result in the formation of a filled gel. The present invention further relates to a method for the preparation of the novel electrorheological gels.

When certain polarizable solid particles are dispersed in an electrically non-conducting hydrophobic liquid, the resulting suspensions exhibit peculiar rheological properties under the influence of an electrical field. These systems show a dramatic increase in viscosity and modulus with applied voltage, in some cases literally being transformed from a liquid to a virtual solid upon the application of the electric field. This change is reversible and typically takes place in a matter of milliseconds. Materials which exhibit this phenomenon are called electrorheological (ER) or electroviscous (EV) fluids, and have been known for at least the last fifty years. These fluids find utility in such areas as torque transfer and mechanical damping applications.

The early ER fluids comprised such systems as starch dispersed in transformer oil or silica gel dispersed in kerosine or mineral oil. Since these early discoveries, only a relatively small number of new systems, and improvements over old ones have emerged in this art.

Electrorheological (ER) fluids are composed of a polarizable solid phase dispersed in a dielectric fluid phase. ER fluids are unique in that they have the ability to change their characteristics from liquid-like to solid-like upon application of an external voltage. This change is reversible which means that the liquid-like state returns upon removal of the electric field. Upon application of a voltage, the solid particles form fibril-like networks which bridge the electrode gap. At this point, the material will not behave as a Newtonian fluid, but will exhibit a Bingham plastic behavior. Fluids exhibiting the Bingham plastic effect require application of a particular level of force (yield stress) before the material will flow again.

ER fluids employing silicone oil as the base fluid phase have also been disclosed. For example, Goossens et. al., in U.S. Pat. No. 4,645,614, teaches an electroviscous suspension which is based on a mixture of aqueous silica gel with silicone oil as the liquid phase to which a dispersant is added. The dispersant consists of amino, hydroxy, acetoxy, or alkoxy functional polysiloxanes having a molecular weight above 800. The electroviscous suspensions are disclosed as being highly compatible with elastomeric materials, non-sedimenting, non-flammable and physiologically acceptable. They are also described as heat and freeze resistant over a wide temperature range and are largely unaffected by temperature and pressure in their viscosity. Goossens et. al. in U.S. Pat. No. 4,668,417 discloses electroviscous fluids which comprise more than 25 weight percent silica gel having an $H_2O$ content of 1 to 15 weight percent dispersed in 1 to 30 weight percent (based on the weight of the $H_2O$ containing silica gel) of a non-conductive oil phase containing a soluble polymer having a molecular weight of 5000 to 1,000,000 and contains 0.1 to 10 weight percent of nitrogen compounds such as amines, amides, imides, or nitriles, or OH containing compounds such as alcohols, and 25–83 weight percent of $C_4$ to C24 alkyl groups. It is further disclosed that these fluids have little or no thixotropic character and undergo little or no phase separation when left to stand and are readily dispersible if phase separation occurs.

Electrorheological fluid compositions having gel-like properties were described in Japanese Patent Application Laid-Open (Kokai or Unexamined) No. 04089893 which discloses an electrorheological fluid consisting of silica particles dispersed in an electrically insulating medium. The electroviscous fluid is taught as containing 10 to 50 percent by volume of spherical particles prepared by hydrolyzing a silicon alkoxide of the formula $Si(OR)_4$ where R is an alkyl group in the presence of an alkali catalyst and drying at a temperature of up to 500° C. This publication further discloses that without a voltage applied the fluid shows good fluidity, while it becomes highly viscous or gel-like reversibly when applied with a voltage. Other such compositions were described in a journal article by Shiga et. al. entitled "Electroviscoelastic effect of polymer gel containing fine particles" (Chemical Abstracts 114:103279z, 1991) which discloses a silicone gel prepared by heating its preoligomer mixed with fine particles of Co(II) polymethacrylic acid salt having a small amount of adsorbed water. Shiga et. al. further disclosed that the electroviscoelastic effect of the silicone gel was larger than that of a suspension of the above particles in a silicone oil.

Moisture curable silicones have been disclosed. For example, Flackett et. al. in U.S. Pat. No. 4,546,017 discloses a sealant composition curable to an elastomer in the presence of moisture obtained by mixing a polydiorganosiloxane having terminal silicon-bonded hydroxyl groups, a defined complex of titanium, and an oxime silane crosslinking agent. The compositions may also contain conventional ingredients such as fillers, curing catalysts, and polydimethylsiloxanes having terminal triorganosiloxy groups. Letoffe et. al., in U.S. Pat. No. 4,824,924 discloses a method for the preparation of a diorganopolysiloxane having polyalkoxy end groups comprising reacting at least one alpha, omegadihydroxydiorganopolysiloxane polymer with at least one polyalkoxysilane in the presence of a catalytically effective amount of at least one organic oxime devoid of silicon. Letoffe et. al. further discloses that the resulting functionalized oils are well adapted for the formulation of single-component, storage-stable organopolysiloxane cold vulcanizable elastomeric compositions.

Other moisture-curable silicone compositions are disclosed in Popa et. al., in U.S. Pat. No. 5,162,460, which discloses a composition consisting essentially of a tetrafunctional or hexafunctional silicone polymer which is modified with a liquid organohydrogensiloxane such that when the functional groups are alkoxy radicals the organohydrogensiloxane contains at least 4 silicon hydride groups per molecule and when the functional groups are oxime groups, the organohydrogensiloxane contains at least 5 silicon hydride groups per molecule, with the proviso that when the functional groups are alkoxy radicals, the silicone composition further comprises an effective amount of a cure catalyst.

In contrast, the present invention relates to an electrorheological gel comprising a curable silicone polymer, electrorheologically active particles, and a metal catalyst which result in the formation of a filled gel which allows for large variations in the storage modulus of the material with the application of an electric field.

SUMMARY OF THE INVENTION

The present invention relates to an electrorheological gel composition comprising: (A) a curable silicone polymer, (B) solid particles, and (C) a metal catalyst. The compositions of the present invention can further comprise (D) an inhibitor, and/or (E) a crosslinking agent.

The present invention further relates to a method for the preparation of electrorheological gels comprising the steps of (I) dispersing solid particles in (A) a curable silicone polymer, and (II) adding (B) a metal catalyst to the mixture of (I). The method can further comprise adding a crosslinking agent and/or inhibitor after step (I).

It is an object of this invention to provide novel electrorheological gels and a method for preparing them.

It is also an object of this invention to produce a filled gel having an electrorheological effect.

It is an additional object of this invention to provide an ER gel having dynamic mechanical properties which can be tuned with an electric field thus resulting in the ability to control the storage modulus of the composition.

It is a further object of this invention to produce an electrorheological gel capable of large increases in dynamic shear storage modulus.

It is another object of this invention to produce an electrorheological gel capable of altering the viscoelastic time-temperature-composition relationship by application of an electric field to the gel.

These and other features, objects and advantages of the present invention will be apparent upon consideration of the following detailed description of the invention.

DETAILED DESCRIPTION OF THE INVENTION

The present invention relates to an electrorheological gel composition comprising: (A) a curable silicone polymer having its formula selected from the group consisting of (i) $(RO)_3SiO(RXSiO)_m(R_2SiO)_nSi(OR)_3$, (ii) $(RO)_3SiO(RXSiO)_m(R_2SiO)_nSi(X)_3$, (iii) $(X)_3SiO(RXSiO)_m(R_2SiO)_nSi(X)_3$, and (iv) mixtures thereof, wherein R is a monovalent hydrocarbon radical having from 1 to 20 carbon atoms, X is independently selected from the group consisting of R, acyloxy groups, hydroxy groups, alkoxy groups, oxime groups, and olefinic hydrocarbon radicals having from 2 to 20 carbon atoms, m has an average value of from 0 to 100, and n has an average value of 100 to 2,000, (B) solid particles, and (C) a metal catalyst and wherein said gel prior to the application of an electric field has a storage modulus of between 500 and 500,000 pascals when measured at a frequency of 10 hertz at 25° C., a peak strain amplitude such that the gel resides in the linear region of viscoelasticity, and has a dynamic mechanical loss tangent of at least 0.5.

Herein the term "moisture curable", as applied to the compositions of this invention, generally denotes the ability of a composition to be cured to a gel at room temperature or at higher temperatures in the presence of moisture. Herein the term "curable", as applied to the compositions of the present invention, generally denotes a chemical change which leads to a change in the state of the composition from a liquid to a solid.

Storage modulus (G') for purposes of the present invention denotes a measure of a materials' elastic properties within a defined strain range, at a given rate, and temperature. The G' value is proportional to the amount of energy stored in a material when it is deformed in shear. The loss modulus (G'') for purposes of the present invention denotes a measure of a materials viscous properties in shear with the same limits as G'. The G'' value is proportional to the energy lost when the material is deformed in shear with losses generally assumed to be in the form of heat. For purposes of the present invention Tan Delta (δ) is the ratio of the loss modulus to the storage modulus (G''/G') and is an indication of the materials ability to damp energy. A Tan Delta greater than one indicates a material which has greater viscous contributions than elastic.

The curable silicone polymer (A) of the present invention comprises an oligomeric silicone compound or composition containing reactive functional groups, by virtue of which it can be cured to a gel state. The term "gel state" as used herein describes a material which is crosslinked so as to exhibit a dynamic mechanical loss tangent (tan δ) of greater than 0.5 when measured at a frequency of 10 Hertz and 25° C. and wherein the peak strain amplitude is utilized such that the material resides in the linear region of viscoelasticity. Preferably, the gel also has a dynamic elastic storage modulus (G') of at least about 500 Pascals under these measurement conditions.

Gel state, as further defined herein, denotes a crosslinked mass having an insoluble gel fraction of at least 10 weight percent when measured in a good solvent for the liquid organopolysiloxane. Before component (A) is cured, it must have a loss tangent of more than about 2.0 and a gel fraction of less than about 10% under the aforementioned conditions. Since solid particles normally employed in electrorheological compositions are insoluble and can impart a significant elastic modulus when dispersed therein, the above mentioned loss tangent and gel fractions are determined on unfilled, neat component (A) for the purposes of the present invention. Alternatively, the gel fraction can be obtained on the filled component (A) if the filler content is subtracted from this measurement. In order to be within the scope of the present invention, the (unfilled) curable silicone polymer (A) must cure to a gelled state, having the above described rheological and solubility properties, within about 12 hours at a temperature of about 100° C.

The above rheological characterization can be accomplished by standard methods known in the art. For example, the neat liquid curable silicone polymer (A), containing the proper amount of a metal catalyst, can be placed on the plates of a dynamic mechanical spectrometer and cured therebetween at the above mentioned conditions. Measurement of dynamic mechanical properties at 10 Hz can be carried out while cure is taking place at elevated temperature and thereafter at 25° C. Similarly, the gelled silicone can be extracted by conventional techniques using a good solvent for the liquid organopolysiloxane to a point where no more material is dissolved, the gel fraction then being determined from the amount of the dried insoluble residue.

In its most general form, the oligomeric component (A) is a curable organopolysiloxane. Thus, for example, component (A) may be selected from any of the filled or unfilled liquid organopolysiloxane room temperature vulcanizing (RTV) systems known in the art which fit within the rheological and solubility restrictions outlined above. One-part RTVs, wherein cure is accomplished by virtue of reactive groups being attached-to organopolysiloxane chains, as well as two-part systems, wherein cure results from the reaction of a low molecular weight crosslinker with reactive groups on the organopolysiloxane, can be used. The scientific and patent literature is replete with examples of these conventional systems and, since these compositions are well known in the art and are available commercially, detailed description thereof is considered unnecessary. By way of illustration, an extensive bibliography of moisture-curable systems is provided in U.S. Pat. No. 3,635,887.

Component (A) in the compositions of the present invention is a curable silicone polymer having its formula selected from the group consisting of (i) $(RO)_3SiO(RXSiO)_m(R_2SiO)_nSi(OR)_3$, (ii) $(RO)_3SiO(RXSiO)_m(R_2SiO)_nSi(X)_3$, (iii) $(X)_3SiO(RXSiO)_m(R_2SiO)_nSi(X)_3$, and (iv) mixtures thereof, wherein R is a monovalent hydrocarbon radical having from 1 to 20 carbon atoms, X is independently selected from the group consisting of R, acyloxy groups, hydroxy groups, alkoxy groups, oxime groups, and olefinic hydrocarbon radicals having from 2 to 20 carbon atoms, m has an average value of from 0 to 100, and n has an average value of from 100 to 2,000.

The monovalent radicals of R in Component (A) can contain up to 20 carbon atoms and include halohydrocarbon radicals free of aliphatic unsaturation and hydrocarbon radicals. Monovalent hydrocarbon radicals include alkyl radicals, such as methyl, ethyl, propyl, butyl, hexyl, and octyl; cycloaliphatic radicals, such as cyclohexyl; aryl radicals, such as phenyl, tolyl, and xylyl; aralkyl radicals, such as benzyl and phenylethyl. Highly preferred monovalent hydrocarbon radical for the silicon-containing components of this invention are methyl and phenyl. Monovalent halohydrocarbon radicals include any monovalent hydrocarbon radical noted above which has at least one of its hydrogen atoms replaced with a halogen, such as fluorine, chlorine, or bromine. Preferred monovalent halohydrocarbon radicals have the formula $C_nF_{2n+1}CH_2CH_2$— wherein the subscript n has a value of from 1 to 10, such as, for example, $CF_3CH_2CH_2$— and $C_4F_9CH_2CH_2$—. The several R radicals can be identical or different, as desired and preferably at least 50 percent of all R radicals are methyl.

The functional group X in the formulae described hereinabove is selected from the group consisting of R, acyloxy groups, hydroxy groups, alkoxy groups, oxime groups, and mixtures thereof. R is as described above including preferred embodiments thereof. Acyloxy groups suitable as X in the compositions of the present invention are exemplified by groups having the formula $$-\overset{\overset{\displaystyle O}{\|}}{O}CR$$

wherein R is a monovalent hydrocarbon radical having from 1 to 10 carbon atoms. Groups suitable as R in the gels of the instant invention include groups such as methyl, ethyl, propyl, butyl, phenyl, aryl, cycloalkyl groups, and cycloaryl groups. Preferred as R groups are methyl, ethyl, propyl, butyl, and phenyl. Preferred as the acyloxy group in the compositions of the instant invention are acetoxy groups such as acetoxy, acetoxyalkyl groups, acetoxyaryl groups, acetoxycycloalkyl groups, acetoxycycloaryl groups.

Hydroxy groups suitable for use in the compositions of the instant invention include hydroxyalkyl groups, hydroxyaryl groups, hydroxycycloalkyl groups, and hydroxycycloaryl groups. Preferred hydroxy (OH) groups as X in the compositions of this invention include groups such as hydroxy, hydroxypropyl, hydroxybutyl, hydroxyphenyl, hydroxymethylphenyl, hydroxyethylphenyl, and hydroxycyclohexyl.

Alkoxy groups suitable as X in component (A) of this invention include groups such as alkoxyalkyl groups, alkoxyaryl groups, alkoxycycloalkyl groups, and alkoxycycloaryl groups. Preferred alkoxy groups for X in the present invention are groups such as methoxy, ethoxy, butoxy, tertiary-butoxy, propoxy, isopropoxy, methoxyphenyl, ethoxyphenyl, methoxybutyl, and methoxypropyl groups.

Oxime groups suitable as X in component (A) in the instant invention preferably have the formula $—ON{=}C(R^1)(R^2)$, wherein $R^1$ and $R^2$ each represent a monovalent hydrocarbon radical having from 1 to 20 carbon atoms or a phenyl radical. Preferred as oxime groups in the instant invention include dimethylketoxime, methylethylketoxime, diethylketoxime, methylpropylketoxime, methylbutylketoxime, methylhexylketoxime, ethylmethylketoxime, ethylpropylketoxime, ethylbutylketoxime, ethylhexylketoxime, methylphenylketoxime, ethylphenylketoxime, phenylmethylketoxime, and diphenylketoxime. Oxime containing silanes such as methyltris(methylethylketoximo)silane, vinyltris(methylethylketoximo)silane, phenyltris(methylethylketoximo)silane, methyltris(diethylketoximo)silane, tetrakis(methylethylketoximo)silane, and partial hydrolyzates thereof are also suitable as X in component (A) of the present invention. It is preferred for purposes of the instant invention that $R^1$ and $R^2$ are selected from the group consisting of methyl and ethyl. A highly preferred oxime group of the instant invention is —ON=C(Me)(Et) wherein Me denotes methyl and Et denotes ethyl. X can also be a mixture of any of the groups described hereinabove.

The olefinic hydrocarbon radicals of X in the present invention may have from 2 to 20 carbon atoms. The olefinic hydrocarbon radicals are preferably selected from the group consisting of the vinyl radical and higher alkenyl radicals represented by the formula $—R^3(CH_2)_cCH{=}CH_2$ wherein $R^3$ denotes $—(CH_2)_d$—or — $(CH_2)_eCH{=}CH$— and c has the value of 1, 2, or 3, d has the value of 3 or 6, and e has the value of 3, 4, or 5. The higher alkenyl radicals represented by the formula $—R^3(CH_2)_cCH{=}CH_2$ contain at least 6 carbon atoms. For example, when $R^3$ denotes $—(CH_2)_d$—, the higher alkenyl radicals include 5-hexenyl, 6- heptenyl, 7-octenyl, 8-nonenyl, 9-decenyl, and 10-undecenyl. When $R^3$ denotes $—(CH_2)_eCH{=}CH$—, the higher alkenyl radicals include, among others, 4,7-octadienyl, 5,8-nonadienyl, 5,9-decadienyl, 6,11-dodecadienyl and 4,8-nonadienyl. Alkenyl radicals selected from the group consisting of 5-hexenyl, 7-octenyl, 9-decenyl, and 5,9-decadienyl, are preferred. It is more preferred that $R^3$ denote $—(CH_2)_d$—so that the radicals contain only terminal unsaturation and the most preferred radicals are the vinyl radical and the 5-hexenyl radical.

Specific examples of preferred polydiorganosiloxanes for use as Component (A) in the compositions of the present invention include $ViMe_2SiO(Me_2SiO)_n$-

$SiMe_2Vi$, $HexMe_2SiO(MeHexSiO)_m(Me_2SiO)_nSiMe_2Hex$, $ViMe_2SiO(MeViSiO)_m(Me_2SiO)_nSiMe_2Vi$, $HexMe_2SiO(MeHexSiO)_4(Me_2SiO)_{196}SiMe_2Hex$, $HexMe_2SiO(MeHexSiO)_2(Me_2SiO)_{198}SiMe_2Hex$, $HexMe_2SiO(MeHexSiO)_3(Me_2SiO)_{151}SiMe_2Hex$, and $ViMe_2SiO(MeViSiO)_2(Me_2SiO)_{130}SiMe_2Vi$, $HexMe_2SiO(Me_2SiO)_nSiMe_2Hex$, $PhMeViSiO(Me_2SiO)_nSiPhMeVi$, $HexMe_2SiO(Me_2SiO)_{130}SiMe_2Hex$, $ViMePhSiO(Me_2SiO)_{145}SiPhMeVi$, $ViMe_2SiO(Me_2SiO)_{130}SiMe_2Vi$, $ViMe_2SiO(Me_2SiO)_{800}SiMe_2Vi$, $ViMe_2SiO(Me_2SiO)_{300}SiMe_2Vi$, $ViMe_2SiO(Me_2SiO)_{900}SiMe_2Vi$, wherein Me, Vi, Hex, and Ph denote methyl, vinyl, 5-hexenyl and phenyl, respectively, and m and n are as defined hereinabove.

Preferably the degree of polymerization of the curable silicone polymer (A) is such that the value of m in (i)–(iii) hereinabove is from 0 to 100, and the value of n is from 100 to 2000. It is preferred for purposes of this invention that the degree of polymerization of the curable silicone polymer is such that the value of m+n is from 300 to 2000. It is highly preferred for the present invention that the value of n is from 500 to 1000.

The amount of Component (A) employed in the compositions of the present invention varies depending on the amount of solid particles and metal catalyst and optionally organohydrogensiloxane and/or inhibitor, that is employed. It is preferred for purposes of this invention that from 40 to 95 weight percent of (A), the curable silicone polymer, be used, and it is highly preferred that from 50 to 80 weight percent of (A) be employed, said weight percent being based on the total weight of the composition.

Component (B) of the compositions of the present invention comprises solid particles. The solid particles of component (B) are electrorheologically active particles, i.e., they exhibit theological properties upon the application of an electrical field. A wide variety of solid particles may be used to form the dispersed phase in the ER gels of this invention. Examples of solid particles which are suitable for the solid phase of the present invention include acid group-containing polymers, silica gel, starch, cellulose, electronic conductors, zeolite, silicone ionomers such as sulfate ionomers of aminofunctional siloxanes, organic polymers containing free salified acid groups, amino acid containing metal polyoxo-salts, organic polymers containing at least partially salified acid groups, homopolymers of monosaccharides or other alcohols, copolymers of monosaccharides or other alcohols, and copolymers of phenols and aldehydes or mixtures thereof. Salified for purposes of the present invention means to form or convert into a salt, or mixed with a salt. Preferred as solid particles in the ER gels of the present invention are corn starch, carboxy modified polyacrylamides, lithium salts of polymethacrylic acid, zeolite, amino acid containing metal polyoxo-salts, and silicone ionomers.

The successful development of electrorheological properties with substances conventionally used as the solid particles (B) such as starch and silica gel requires the presence in the ER gel of a minimum amount of water. However, a new class of solid phase materials which function under anhydrous conditions has recently been taught in Great Britain Patent Specification No. 2170510 which is hereby incorporated by reference. These new solid phase materials are electronic conductors, particularly organic semiconductors, and such may be used as the solid particles (B) in the compositions of the present invention to provide ER gels of particularly advantageous properties.

The solid particles of the present invention can also be amino acid containing metal polyoxo-salts such as those disclosed in copending U.S. application for patent, Ser. No. 07/874,450, filing date Apr. 27, 1992, and assigned to the same assignee as this present application, now U.S. Pat. No. 5,320,770, incorporated herein by reference. These solid particles are generally compounds having the general formula:

$$[(M)^p(H_2O)_x(OH)_y]^q{}_c[A]^r{}_d \cdot B_z \cdot nH_2O$$

wherein M is a metal cation or a mixture of metal cations at various ratios; p is the total valence of M and has a value of greater than zero; x is zero or has a value greater than zero, y is zero or has a value greater than zero, with the proviso that only one of x or y can be zero at any given time; q has a value of p minus y with the proviso that q has a value of at least one; c has a value of greater than zero; A is an anion or a mixture of anions at various ratios; r is the total valence of A with the proviso that r has a value of at least one; d has a value of greater than zero with the proviso that $(q \times c)$ is always equal to $(r \times d)$; B is an amino acid or a mixture of amino acids; z has a value of from 0.01 to 100; and n is a number from 0 to 15.

Preferably the solid particles (B) are silicone ionomers. The preferred silicone ionomers are those which are a reaction product of (I) an amine functional diorganopolysiloxane having a degree of polymerization of less than about 10,000 in which at least about 3 mole percent of the silicon atoms have attached thereto, through silicon-carbon bonds, an amine functional organic group bearing at least one —NHR″ group, in which R″ is selected from the group consisting of hydrogen and an alkyl radical having from 1 to 6 carbon atoms, and (II) and acid such as those described by Chung, in U.S. Pat. No. 4,994,198 incorporated herein by reference. It is highly preferred for purposes of the present invention that the solid particle (B) is a sulfate ionomer of an aminofunctional siloxane.

The particle size of the solid particles of the present invention preferably should lie within the range from 1–200 microns, and more preferably be from 5–40 microns. The particle size of the solid particles in the compositions of the present invention is not critical, however the particle size successfully employed in the gel of the invention range from about 5 microns to 150 microns, with an average particle size of 30 to 50 microns.

Typically, from about 5 to about 60 weight percent of the solid particles (B) by weight percent of the gel is dispersed into the siloxane fluid phase of the present invention. Preferably about 20 to about 50 weight percent of the solid particles are dispersed into the fluid phase for the compositions of the present invention. However, the optimum amount that is used depends greatly on the specific type of solid particle that is employed, the type of organosiloxane base liquid that is selected, gel viscosity, and intended application, among other variables. Those skilled in the art will readily determine the proper proportions in any given system by routine experimentation.

Component (C) in the compositions of the present invention is a metal catalyst. The metal catalyst for purposes of the present invention is preferably selected from the group consisting of organo compounds of tin, organo compounds of titanium, platinum, and complexes thereof. Catalysts suitable as (C) in the compositions of this invention include organotitanates such as tetraisopropyl titanate, tetrabutyl titanate, tetraethylhexyl titanate, tetraphenyltitanate, and triethanolamine titanate, and organometallic compounds such as dibutyltin dilaurate, stannous acetate, stannous octoate, stannous benzoate, stannous sebacate, stannous succinate, tin octoate, dibutyltin diacetate, zinc octoate, cobalt octoate, stannous napthanate, cobalt naphthanate, titanium naphthanate, cerium naphthanate, siloxytitanates such as tetrakis(trimethylsiloxy)titanium and bis(trimethylsiloxy)bis(isopropoxy)titanium, and betadicarbonyltitanium compounds such as bis(acetylacetonyl) diisopropyl titanate.

Component (C) in the compositions of the present invention can also be a Group VIII metal catalyst or a complex thereof. By Group VIII metal catalyst it is meant herein iron, cobalt, nickel, ruthenium, rhodium, palladium, osmium, iridium and platinum. The metal catalyst of Component (C) can be a platinum containing catalyst component since they are the most widely used and available. Platinum-containing catalysts can be platinum metal, optionally deposited on a carrier, such as silica gel or powdered charcoal; or a compound or complex of a platinum group metal. A preferred platinum-containing catalyst component in the compositions of this invention is a form of chloroplatinic acid, either as the commonly available hexahydrate form or as the anhydrous form, as taught by Speier, U.S. Pat. No. 2,823,218, incorporated herein by reference. A particularly useful form of chloroplatinic acid is that composition obtained when it is reacted with an aliphatically unsaturated organosilicon compound such as divinyltetramethyldisiloxane, as disclosed by Willing, U.S. Pat. No. 3,419,593, incorporated herein by reference, because of its easy dispersibility in organosilicon systems. Other catalysts which are useful in the present invention include those disclosed in U.S. Pat. Nos. 3,159,601; 3,159,662; 3,220,972; 3,296,291; 3,516,946; 3,814,730 and 3,928,629, incorporated herein by reference. Other Group VIII metal catalysts suitable as Component (C) for the compositions of the present invention include $RhCl_3$, $RhBr_3$, $RhI_3$, and complexes thereof, although as described hereinabove it is preferred that platinum catalyst systems be employed such as $ClRh(PPh_3)_3$ and complexes thereof; $H_2PtCl_6$; a complex of 1,3-divinyl tetramethyl disiloxane and $H_2PtCl_6$; alkyne complexes of $H_2PtCl_6$, or a form of chloroplatinic acid, either as the commonly available hexahydrate form or as the anhydrous form.

It is preferred that catalyst (C) is selected from the group consisting of tetrabutyltitanate, stannous octoate, chloroplatinic acid, diisopropoxy-diethylacetoacetate titanate, 2,5-di-isopropoxy-bis-ethylacetoacetate titanate and titanium bis(ethyl aceto-acetate) diisopropoxy isopropyl alcohol.

The amount of metal catalyst, Component (C), that is used in the compositions of this invention is not narrowly limited and can be readily determined by one skilled in the art by routine experimentation. Component (C) should be added in a quantity sufficient to effect curing of the composition of the present invention. However, the most effective concentration of catalyst has been found to be from about 0.001 to 10 parts by weight of the catalyst per 100 parts by weight of the curable silicone polymer Component (A), and is preferably added at 0.01 to 1 part by weight per 100 parts of Component (A).

The composition can optionally further comprise (D) a crosslinking agent. Preferably the crosslinking agent as Component (D) in the compositions of the present invention is at least one organohydrogensilicon compound which is free of aliphatic unsaturation and contains two or more silicon atoms linked by divalent radicals, an average of from one to two silicon-bonded monovalent radicals per silicon atom and an average of at least one, and preferably two, three or more silicon-bonded hydrogen atoms per molecule thereof. Preferably the organohydrogensiloxane in the compositions of the present invention contains an average of three or more silicon-bonded hydrogen atoms such as, for example, 5, 10, 20, 40, 70, 100, and more.

The organohydrogenpolysiloxane is preferably a compound having the average unit formula $R_a^4H_bSiO_{(4-a-b)/2}$ wherein $R^4$ denotes said monovalent radical free of aliphatic unsaturation, the subscript b has a value of from greater than 0 to 1, such as 0.001, 0.01, 0.1 and 1.0, and the sum of the subscripts a plus b has a value of from 1 to 3, such as 1.2, 1.9 and 2.5. Siloxane units in the organohydrogenpolysiloxanes having the average unit formula immediately above have the formulae $R_3^4SiO_{1/2}$, $R_2^4HSiO_{1/2}$, $R_2^4SiO_{2/2}$, $R^4HSiO_{2/2}$, $R^4SiO_{3/2}$, $HSiO_{3/2}$ and $SiO_{4/2}$. Said siloxane units can be combined in any molecular arrangement such as linear, branched, cyclic and combinations thereof, to provide organohydrogenpolysiloxanes that are useful as component (D) in the compositions of the present invention.

A preferred organohydrogenpolysiloxane for the compositions of this invention is a substantially linear organohydrogenpolysiloxane having the formula $ZR_2SiO(ZRSiO)_cSiR_2Z$ wherein each R denotes a monovalent hydrocarbon or halohydrocarbon radical free of aliphatic unsaturation and having from 1 to 20 carbon atoms. Monovalent hydrocarbon radicals include alkyl radicals, such as methyl, ethyl, propyl, butyl, hexyl, and octyl; cycloaliphatic radicals, such as cyclohexyl; aryl radicals, such as phenyl, tolyl, and xylyl; aralkyl radicals, such as benzyl and phenylethyl. Highly preferred monovalent hydrocarbon radical for the silicon-containing components of this invention are methyl and phenyl. Monovalent halohydrocarbon radicals free of aliphatic unsaturation include any monovalent hydrocarbon radical noted above which is free of aliphatic unsaturation and has at least one of its hydrogen atoms replaced with a halogen, such as fluorine, chlorine, or bromine. Preferred monovalent halohydrocarbon radicals have the formula $C_nF_{2n+1}CH_2CH_2$— wherein the subscript n has a value of from 1 to 10, such as, for example, $CF_3CH_2CH_2$— and $C_4F_9CH_2CH_2$—. The several R radicals can be identical or different, as desired. Additionally, each Z denotes a hydrogen atom or an R radical. Of course, at least two Z radicals must be hydrogen atoms. The exact value of y depends upon the number and identity of the R radicals; however, for organohydrogenpolysiloxanes containing only methyl radicals as R radicals c will have a value of from about 0 to about 1000.

In terms of preferred monovalent hydrocarbon radicals, examples of organopolysiloxanes of the above formulae which are suitable as the organohydrogensiloxane for the compositions of this invention include $HMe_2SiO(Me_2SiO)_cSiMe_2H$, $(HMe_2SiO)_4Si$, cyclo-$(MeHSiO)_c$, $(CF_3CH_2CH_2)MeHSiO\{Me(CF_3CH_2CH_2)SiO\}_cSiHMe(CH_2CH_2CF_3)$, $Me_3SiO(MeHSiO)_c$.

$SiMe_3$, $HMe_2SiO(Me_2SiO)_{0.5c}(MeHSiO)_{0.5c}SiMe_2H$, $HMe_2SiO(Me_2SiO)_{0.5c}(MePhSiO)_{0.1c}(MeHSiO)_{0.4c}SiMe_2H$, $Me_3SiO(Me_2SiO)_{0.3c}(MeHSiO)_{0.7c}SiMe_3$ and $MeSi(OSiMe_2H)_3$ organohydrogenpolysiloxanes that are useful as Component (D).

Highly preferred linear organohydrogenpolysiloxanes for the compositions of this invention have the formula $ZMe_2SiO(Me_2SiO)_p(MeZSiO)_qSiMe_2Z$ wherein Z denotes a hydrogen atom or a methyl radical. An average of at least two Z radicals per molecule must be hydrogen atoms. The subscripts p and q can have average values of zero or more and the sum of p plus q has a value equal to c, noted above. The disclosure of U.S. Pat. No. 4,154,714 shows highly-preferred organohydrogenpolysiloxanes.

Especially preferred as Component (D) are methylhydrogensiloxanes selected from the group consisting of bis(trimethylsiloxy)dimethyldihydrogendisiloxane, diphenyldimethyldisiloxane, diphenyltetrakis(dimethylsiloxy)disiloxane, heptamethylhydrogentrisiloxane, hexamethyldihydrogentrisiloxane, methylhydrogencyclosiloxanes, methyltris(dimethylhydrogensiloxy)silane, pentamethylpentahydrogencyclopentasiloxane, pentamethylhydrogendisiloxane, phenyltris(dimethylhydrogensiloxy)silane, polymethylhydrogensiloxane, tetrakis(dimethylhydrogensiloxy)silane, tetramethyltetrahydrogencyclotetrasiloxane, tetramethyldihydrogendisiloxane, and methylhydrogendimethylsiloxane copolymers.

The amount of Component (D), if employed in the compositions of the present invention, varies depending on the amount of curable silicone polymer, solid particles, and metal catalyst that is employed. It is preferred for purposes of this invention that Component (D) comprise from 0 to 10 weight percent of the total formulation.

The compositions of the instant invention can also optionally further comprise (E) an inhibitor. The inhibitor (E) can be employed in combination with crosslinker (D) or can be used in the absence of crosslinker (D). Component (E) of the compositions of this invention is any material that is known to be, or can be, used as an inhibitor for the catalytic activity of platinum group metal- containing catalysts. By the term "inhibitor" it is meant herein a material that retards the room temperature curing of a curable mixture of Components (A), (B), (C), and optionally (D) when incorporated therein in small amounts, such as less than 10 percent by weight of the composition, without preventing the elevated curing of the mixture. Inhibitors for the platinum group metal catalysts are well known in the organosilicon art. Examples of various classes of such metal catalyst inhibitors include unsaturated organic compounds such as ethylenically or aromatically unsaturated amides, U.S. Pat. No. 4,337,332; acetylenic compounds, U.S. Pat. Nos. 3,445,420 and 4,347,346; ethylenically unsaturated isocyanates, U.S. Pat. No. 3,882,083; olefinic siloxanes, U.S. Pat. No. 3,989,667; unsaturated hydrocarbon diesters, U.S. Patent Nos. 4,256,870; 4,476,166 and 4,562,096, and conjugated ene-ynes, U.S. Patent Nos. 4,465,818 and 4,472,563; other organic compounds such as hydroperoxides, U.S. Pat. No. 4,061,609; ketones, sulfoxides, amines, phosphines, and phosphites; nitriles such as those disclosed in U.S. Pat. No. 3,344,111; diaziridines, U.S. Pat. No. 4,043,977; and various salts, such as U.S. Pat. No. 3,461,185.

Organic inhibitor compounds which bear aliphatic unsaturation and one or more polar groups, such as carbonyl or alcohol groups are preferred as (E) in the instant invention. Examples thereof include the acetylenic alcohols of Kookootsedes and Plueddemann, U.S. Pat. No. 3,445,420, such as ethynylcyclohexanol and methylbutynol; the unsaturated carboxylic esters of Eckberg, U.S. Pat. No. 4,256,870, such as diallyl maleate and dimethyl maleate; and the maleates and fumarates of Lo, U.S. Patent Nos. 4,562,096 and 4,774,111 , such as diethyl fumarate, diallyl fumarate, and bis-(methoxyisopropyl) maleate. The half esters and amides of Melancon, U.S. Pat. No. 4,533,575; and the inhibitor mixtures of Eckberg, U.S. Pat. No. 4,476,166 would also be expected to behave similarly. The above-mentioned patents relating to inhibitors for platinum group metal-containing catalysts are incorporated herein by reference to teach how to prepare compounds which are suitable for use as Component (E) in the compositions of this invention. Maleates and fumarates are the preferred inhibitors for the compositions of this invention.

The maleates and fumarates that are preferred as Component (E) in the compositions of this invention have the formula $R^5(OQ)_tO_2CCH{=}CHCO_2(QO)_tR^5$ wherein $R^5$ denotes a monovalent hydrocarbon radical having from 1 to 10 carbon atoms and each Q denotes, independently, an alkylene radical having from 2 to 4 carbon atoms. $R^5$ can be, for example, an alkyl radical such as methyl, ethyl, propyl, isopropyl, butyl, pentyl, or hexyl; an aryl radical such as phenyl or benzyl; an alkenyl radical such as vinyl or allyl; alkynyl radicals; or a cyclohydrocarbon radical such as cyclohexyl. Q can be for example, $-CH_2CH_2-$, $-CH_2(CH_3)CH-$, $-CH_2CH_2CH_2-$, $-CH_2CH_2CH_2CH_2-$, $-CH_2(CH_3CH_2)CH-$ and $-CH_2CH_2(CH_3)CH-$. The individual $R^5$ radicals and Q radicals of the maleates and fumarates can be identical or different, as desired. The value of subscript t in the formula immediately above can a value equal to zero or 1. The individual values of t can be identical or different, as desired. Bis-methoxyisopropyl maleate and diethyl fumarate are preferred as inhibitors for the present invention.

The amount of Component (E) to be used in the compositions of this invention is not critical and can be any amount that will retard the above described catalyzed reaction at room temperature while not preventing said reaction at elevated temperature. No specific amount of inhibitor can be suggested to obtain a specified bath life at room temperature since the desired amount of any particular inhibitor to be used will depend upon the concentration and type of the platinum group metal containing catalyst, the nature and amounts of Components (A), (B), and (C), and the presence or absence of optional ingredients. A practical range appears to be 0.5 to 1.05 percent of the total formulation for a maleate inhibitor and 0.8 to 2.0 percent of the total formulation for a fumarate inhibitor. Other preferred inhibitors for the present invention are alcohols, for example aromatic alcohols such as benzyl alcohol or n-octanol. Also preferred for the present invention is a combination of diethyl fumarate as the inhibitor complexed with benzyl alcohol as (E). We have generally taught the broad and narrow limits for the inhibitor component concentration for the compositions of this invention, however, one skilled in the art can readily determine the optimum level for each application as desired.

The present invention further relates to a method for the preparation of an electrorheological gel comprising the steps of: (I) dispersing solid particles in (A) a curable silicone polymer having its formula selected from the group consisting of (i) $(RO)_3SiO(RXSiO)_m(R_2SiO)_nSi(OR)_3$,
(ii) $(RO)_3SiO(RXSiO)_m(R_2SiO)_nSi(X)_3$,
(iii) $(X)_3SiO(RXSiO)_m(R_2SiO)_nSi(X)_3$, and
(iv) mixtures thereof wherein R is a monovalent hydrocarbon radical having from 1 to 20 carbon atoms, X is independently selected from the group consisting of R, acyloxy groups, hydroxy groups, alkoxy groups, oxime groups, and olefinic hydrocarbon radicals having from 2 to 20 carbon atoms, m has an average value of from 0 to 100, and n has an average value of from 100 to 2000, and (II) adding (B) a metal catalyst to the mixture of (I) wherein said gel prior to the application of an electric field has a storage modulus of between 500 and 500,000 pascals when measured at a frequency of 10 hertz at 25° C., a peak strain amplitude such that the gel resides in the linear region of viscoelasticity, and has a dynamic mechanical loss tangent of at least 0.5. Components (A), (B), and the solid particles are as delineated above for the compositions of the present invention including preferred embodiments thereof. The method of the present invention can further comprise adding (C) a crosslinking agent after step (I), and/or adding (D) an inhibitor after step (I). The crosslinking agent (C) and inhibitor (D) are as delineated above for the compositions of the present invention including preferred embodiments thereof. Furthermore the electrorheological composition of the present invention can be heated, preferably to a temperature of from 25° to 100° C. prior to its use.

Dispersion of the solid particles in the gel phase of the present invention is preferably accomplished by any of the commonly accepted methods, such as those employing a ball mill, paint mill, and a high shear mixer. During this dispersion process, the solid particles and organosiloxane base gel are sheared at a high rate, thereby reducing the size of the particles. It has been found that a final particle size having an average diameter of about 5 to 40 micrometers is preferred. If the diameter is above 100 microns, the particles tend to settle out and limit the number of particles that can fit between the electrodes, while if the diameter is too low, thermal Brownian motion of the particles tends to reduce the ER effect.

An equivalent dispersion of the solid particles in the base gel in the compositions of this invention may also be effected by first grinding the particles to a suitable fineness or spray drying the solid particles and subsequently mixing them into the uncured gel composition of the present invention.

The present invention also relates to a device using an electrorheological gel composition, said electrorheological gel composition comprising: (A) a curable silicone polymer having its formula selected from the group consisting of (i) $(RO)_3SiO(RXSiO)_m(R_2SiO)_nSi(OR)_3$,
(ii) $(RO)_3SiO(RXSiO)_m(R_2SiO)_nSi(X)_3$,
(iii) $(X)_3SiO(RXSiO)_m(R_2SiO)_nSi(X)_3$, and
(iv) mixtures thereof, wherein R is a monovalent hydrocarbon radical having from 1 to 20 carbon atoms, X is independently selected from the group consisting of R, acyloxy groups, hydroxy groups, alkoxy groups, oxime groups, and olefinic hydrocarbon radicals having from 2 to 20 carbon atoms, m has an average value of from 0 to 100, and n has an average value of from 100 to 2,000, (B) solid particles, and (C) a metal catalyst and wherein said gel prior to the application of an electric field has a storage modulus of between 500 and 500,000 pascals when measured at a frequency of 10 hertz at 25° C., a peak strain amplitude such that the gel resides in the linear region of viscoelasticity, and has a dynamic mechanical loss tangent of at least 0.5. The composition in the device of the present invention can further comprise (D) a crosslinking agent, and/or (E) an inhibitor. The crosslinking agent (D) and inhibitor (E) are as delineated above for the compositions of the present invention including preferred embodiments thereof.

The present invention further relates to a method of using an electrorheological gel composition comprising: (I) applying an electric field across the electrorheological gel composition, said electrorheological gel composition comprising: (A) a curable silicone polymer having its formula selected from the group consisting of (i) $(RO)_3SiO(RXSiO)_m(R_2SiO)_nSi(OR)_3$;
(ii) $(RO)_3SiO(RXSiO)_m(R_2SiO)_nSi(X)_3$;
(iii) $(X)_3SiO(RXSiO)_m(R_2SiO)_nSi(X)_3$; and
(iv) mixtures thereof, wherein R is a monovalent hydrocarbon radical having from 1 to 20 carbon atoms, X is independently selected from the group consisting of R, acyloxy groups, hydroxy groups, alkoxy groups, oxime groups, and olefinic hydrocarbon radicals having from 2 to 20 carbon atoms, m has an average value of from 0 to 100, and n has an average value of from 100 to 2,000, (B) solid particles, and (C) a metal catalyst, wherein said gel prior to the application of the electric field has a storage modulus of between 500 and 500,000 pascals when measured at a frequency of 10 hertz at 25° C., a peak strain amplitude such that the gel resides in the linear region of viscoelasticity, and has a dynamic mechanical loss tangent of at least 0.5.

If desired, a dispersant such as a hydrogenated castor oil, an organic solvent such as hexane, heptane, toluene, xylene, mineral spirits, ketones, or acetates, cyclic or linear alkanes, aromatic hydrocarbons such as benzene, and low molecular weight linear and cyclic polydimethylsiloxanes may be incorporated into the electrorheological compositions of the instant invention however, it is an advantage of the ER gels of the present invention that they are in general quite physically stable and do not require the inclusion of a dispersant or solvent to maintain the solid phase sufficiently dispersed. The ER gel compositions of the present invention may further comprise antioxidants, stabilizers, colorants, and dyes. When some of the compositions of the present invention produced by the method of this invention are exposed to moisture, they can cure resulting in a gelled silicone.

The viscoelastic properties of materials are functions of chemical composition and structure as well as the temperature, applied strain amplitude, and the applied strain rate. Generally, when all these variables are fixed the viscoelastic properties are fixed. However, electrorheological gels can alter the viscoelastic time-temperature-composition relationship by subjecting the gel to an electric field. A gel can be shifted from a predominantly viscous material (tan delta$>1$) to a predominantly elastic material (tan delta$<1$) by applying an electric field across the gel. Additionally, formulations can be made where the elastic contribution is always the dominant component, and the dominance can be increased by the application of the electric field. The ability to control a cured gels' viscoelastic properties by applying electric fields will allow for novel methods of controlling implied stresses.

Potential applications of these electrorheological gels may be found in constrained layer composite systems for the use of vibration damping and controlled stiffness applications. Multi-layered composites consisting of layers of electrorheological gel with alternating layers of electrodes (i.e. metal foils, conductive polymer films, etc.) can be fabricated and with the ER gels of the present invention could be designed to dampen changes in mechanical or acoustical vibration. Further, the ability to alter the elastic modulus would permit a system which could alter the levels of energy transmittance by stiffening or relaxing the electrorheological gel material in the laminate by controlling the electric field applied across each gel layer.

The ER gel samples prepared hereinbelow were evaluated in parallel disk geometry on a Rheometrics Dynamic Spectrometer (RDS2). Parallel disk geometry refers to a disk specimen which is placed between two parallel plates. The RDS2 shears the sample by oscillating the lower plate in a sinusoidal pattern. The amplitude of the oscillations is determined by the thickness of the sample and the desired level of strain. All of these values are input into a controlling computer.

The test values shown in the tables are frequency sweeps at set strains. The frequency in the examples hereinbelow was set at 50 rad/s with the strain set at 0.5%. The parallel plates in the examples hereinbelow were about 50 millimeters in diameter. This data shows how the ER gel responds to the applied strains. The values of G' increase when an electric field is applied which indicates the material is behaving as a stiffer spring than when no electric field is applied. Tan delta decreases when the electric field is applied which indicates the materials behavior is becoming more elastic.

EXAMPLES

The following examples are presented to further illustrate the compositions of this invention, but are not to be construed as limiting the invention which is delineated in the appended claims. All parts and percentages in the examples are on a weight basis unless indicated to the contrary.

Example I

An electrorheological gel of the instant invention was prepared. About 4.05 grams of an organopolysiloxane having the formula: $ViMe_2SiO(Me_2SiO)_{900}SiMe_2Vi$ (Polymer B) was added to an aluminum weighing pan. Next 0.45 grams of a silicone polymer having the formula: $(MeO)_3SiCH_2CH_2SiO(Me_2SiO)_{900}SiCH_2CH_2Si(OMe)_3$ (polymer A) was added to the pan plus 2.0 grams of toluene. The items were mixed with a spatula, and then 0.5 grams of 100 mole % amine hydrolyzate sulfate ionomer particles prepared according to the disclosure of Chung et. al., U.S. Pat. No. U.S. Pat. No. 4,994,198, were mixed into the system. The amine hydrolyzate sulfate ionomer particles were prepared by combining an amine hydrolyzate which was a mixture of linear and cyclic organopolysiloxanes having the formula $OCH_3RCH_3SiO(CH_3RSiO)_xSiCH_3RCH_3O$ having a viscosity on average of about 1300 centistokes and wherein R is $CH_2CH(CH_3)CH_2NHCH_2CH_2NH_2$ with sulfuric acid in an aqueous solution. A ratio of one mole of $H_2SO_4$ to one mole of R was used to prepare the particles. The water was then removed to produce the 100 mole percent amine hydrolyzate sulfate ionomer particles. A drop of diisopropoxy-diethylacetoacetate titanate (TDIDE) cataylst was added with stirring and the system allowed to remain exposed to the environment for 24 hours under ambient conditions. The samples were then placed in an oven at 50° C. for 24 hours followed by 5 hours at 120° C. The cured electrorheological gel was removed from the pan and evaluated for an electrorheological effect (i.e. increases in modulus upon the application of an electric field). The amount of electric field (voltage) applied to the electrorheological gel of the present invention, and the resulting Dynamic Storage Modulus and Tan Delta are presented in Table I hereinbelow.

TABLE I

| Applied Electric Field E(kV//m) | Dynamic Storage Modulus G' (Pascals) | Tangent Delta |
|---|---|---|
| 0 | $4.7054 \times 10^3$ | 2.0805 |
| 1.0 | $4.9774 \times 10^3$ | 2.0701 |
| 2.0 | $6.7115 \times 10^3$ | 1.7393 |

Example II

About 1.50 grams of polymer B (described in Example 1 above) was mixed with 0.35 grams of polymer A (also described in Example 1 above) plus 2.0 grams of toluene in an aluminum weighing pan. Next 1.50 grams of the 100 mole % amine hydrolyzate sulfate ionomer particles were added and the mixture stirred until uniform dispersion obtained. Next 1 drop of TDIDE catalyst was added, stirred and the mixture was left in ambient conditions for 24 hours. The samples were then placed in an oven at 50° C. for 24 hrs followed by 5 hrs at 120° C. The cured electrorheological gel was removed from the pan and evaluated for an electrorheological effect (i.e. increases in modulus upon the application of an electric field). The amount of electric field (voltage) applied to the electrorheological gel of the present invention, and the resulting Dynamic Storage Modulus and Tan Delta are presented in Table II hereinbelow.

TABLE II

| Applied Field Potential E(kV/mm) | Dynamic Storage Modulus G' (Pascals) | Tangent Delta |
|---|---|---|
| 0 | $4.2167 \times 10^4$ | 1.2506 |
| 1.0 | $8.6034 \times 10^4$ | 0.8977 |
| 2.0 | $1.5823 \times 10^5$ | 0.7165 |

Example III

In this example, about 2.80 grams of polymer B was mixed with 1.20 grams of polymer A plus 2.0 grams of toluene in an aluminum weighing pan. Next 1.00 grams of the 100 mole % amine hydrolyzate sulfate ionomer particles were added and the mixture stirred until uniform dispersion obtained. Next 1 drop of TDIDE catalyst was added, stirred and the mixture was left in ambient conditions for 24 hours. The samples were then placed in an oven at 50° C. for 24 hours followed by 5 hours at 120° C. The cured electrorheological gel was removed from the pan and evaluated for an electrorheological effect (i.e. increases in modulus upon the application of an electric field). The amount of electric field (voltage) applied to the electrorheological gel of the present invention, and the resulting Dynamic Storage Modulus and Tan Delta are presented in Table III hereinbelow.

TABLE III

| Applied Electric Field E(kV/mm) | Dynamic Storage Modulus G' (Pascals) | Tangent Delta |
|---|---|---|
| 0 | $6.0689 \times 10^4$ | 0.6641 |
| 1.0 | $6.5309 \times 10^4$ | 0.6462 |
| 2.0 | $7.1080 \times 10^4$ | 0.6260 |

Example IV

In a 100 ml beaker, 29.62 grams of an organopolysiloxane having the formula: $ViMe_2SiO(Me_2SiO)_{130}SiMe_2Vi$, 0.26 grams of an organohydrogensiloxane crosslinking agent having the formula $Me_3SiO(MeHSiO)_5(Me_2SiO)_3SiMe_3$, and 30 grams of corn starch were mixed together. Next, a catalytic amount (about $2\times10^{-5}$ parts per hundred) of platinum was added and the mixture was stirred. Samples ranging from 3 to 10 grams were poured into aluminum weighing pans. The pans were placed in a vacuum oven set at 50° C., and the pressure was reduced to about 5 inches Hg to de-air the samples. The vacuum was removed after about 5 minutes. The temperature was increased to about 70° C. and the samples were cured for 12 hours prior to evaluation. The cured electrorheological gels were removed from the pan and evaluated for an electrorheological effect (i.e. increases in modulus upon the application of an electric field) and values typical of the compositions of the present invention were reported in Table IV below. The amount of electric field (voltage) applied to the electrorheological gels of the present invention, and the resulting Dynamic Storage Modulus and Tan Delta are presented in Table IV hereinbelow.

TABLE IV

| Applied Electric Field E(kV/mm) | Dynamic Storage Modulus G' (Pascals) | Tangent Delta |
|---|---|---|
| 0 | $3.9824 \times 10^3$ | 0.5244 |
| 1.0 | $4.6115 \times 10^3$ | 0.5074 |
| 2.0 | $6.4610 \times 10^3$ | 0.4881 |

Example V

In a 100 ml beaker, 29.62 grams of an organopolysiloxane having the formula: $ViMe_2SiO(Me_2SiO)_{130}SiMe_2Vi$, 0.26 grams of an organohydrogensiloxane crosslinking agent having the formula $Me_3SiO(MeHSiO)_5(Me_2SiO)_3SiMe_3$, and 30 grams of Aluminum Zirconium Proline (AZP) were mixed together. Next, a catalytic amount (about $2\times10^{-5}$ parts per hundred of the organopolysiloxane polymer) of platinum was added and the mixture was stirred. Samples ranging from 3 to 10 grams were poured into aluminum weighing pans. The pans were placed in a vacuum oven set at 50° C., and the pressure was reduced to about 5 inches Hg to de-air the samples. The vacuum was removed after about 5 minutes. The temperature was increased to about 70° C. and the samples were cured for 12 hours prior to evaluation. The cured electrorheological gels were removed from the pan and evaluated for an electrorheological effect (i.e. increases in modulus upon the application of an electric field) and values typical of the compositions of the present invention were reported in Table V below. The amount of electric field (voltage) applied to the electrorheological gels of the present invention, and the resulting Dynamic Storage Modulus and Tan Delta are presented in Table V hereinbelow.

TABLE V

| Applied Electric Field E(kV/mm) | Dynamic Storage Modulus G' (Pascals) | Tangent Delta |
|---|---|---|
| 0 | $1.4672 \times 10^3$ | 0.8189 |
| 2.0 | $1.5545 \times 10^3$ | 0.8420 |
| 3.0 | $2.5947 \times 10^3$ | 0.6680 |
| 4.0 | $7.3053 \times 10^3$ | 0.5393 |

It should be apparent from the foregoing that many other variations and modifications may be made in the compounds, compositions and methods described herein without departing substantially from the essential features and concepts of the present invention. Accordingly it should be clearly understood that the forms of the invention described herein are exemplary only and are not intended as limitations on the scope of the present invention as defined in the appended claims.

That which is claimed is:

1. An electrorheological gel composition comprising:

(A) a curable silicone polymer having its formula selected from the group consisting of (i) $(RO)_3SiO(RXSiO)_m(R_2SiO)_nSi(OR)_3$;

(ii) $(RO)_3SiO(RXSiO)_m(R_2SiO)_nSi(X)_3$;

(iii) $(X)_3SiO(RXSiO)_m(R_2SiO)_nSi(X)_3$; and (iv) mixtures thereof;

wherein R is a monovalent hydrocarbon radical having from 1 to 20 carbon atoms, X is independently selected from the group consisting of R, acyloxy groups, hydroxy groups, alkoxy groups, oxime groups, and olefinic hydrocarbon radicals having from 2 to 20 carbon atoms, m has an average value of from 0 to 100, and n has an average value of from 100 to 2,000;

(B) electrorheologically active solid particles; and (C) a metal catalyst;

wherein said gel prior to the application of an electric field has a storage modulus of between 500 and 500,000 pascals when measured at a frequency of 10 hertz at 25° C., a peak strain amplitude such that the gel resides in the linear region of viscoelasticity, and has a dynamic mechanical loss tangent of at least 0.5.

2. A composition according to claim 1, wherein the composition further comprises a crosslinking agent.

3. A composition according to claim 1, wherein the composition further comprises an inhibitor that retards the room temperature curing of a curable mixture of (A), (B), and (C).

4. A composition according to claim 2, wherein the composition further comprises an inhibitor that retards the room temperature curing of a curable mixture of (A), (B), and (C).

5. A composition according to claim 1, wherein X is selected from the group consisting of methyl, phenyl, acetoxy, acetoxyalkyl groups, acetoxyaryl groups, acetoxycycloalkyl groups, acetoxycycloaryl groups, hydroxy, hydroxyalkyl groups, hydroxyaryl groups, hydroxycycloalkyl groups, hydroxycycloaryl groups, alkoxy, alkoxyalkyl groups, alkoxyaryl groups, alkoxycycloalkyl groups, alkoxycycloaryl groups, and groups having the formula $—ON{=}C(R^1)(R^2)$, wherein $R^1$ and $R^2$ each represent a monovalent hydrocarbon radical having from 1 to 20 carbon atoms or a phenyl radical.

6. A composition according to claim 5, wherein X is selected from the group consisting of acetoxyethyl, acetoxypropyl, acetoxybutyl, acetoxyphenyl, acetoxycyclohexyl, hydroxypropyl, hydroxybutyl, hydroxyphenyl, hydroxymethylphenyl, hydroxyethylphenyl, hydroxycyclohexyl, methoxy, ethoxy, butoxy, tertiary-butoxy, propoxy, isopropoxy, methoxyphenyl, ethoxyphenyl, methoxybutyl, methoxypropyl, dimethylketoxime, methylethylketoxime, diethylketoxime, methylpropylketoxime, methylbutylketoxime, methylhexylketoxime, ethylmethylketoxime, ethylpropylketoxime, ethylbutylketoxime, ethylhexylketoxime, methylphenylketoxime, ethylphenylketoxime, phenylmethylketoxime, diphenylketoxime, methyltris(methylethylketoximo)silane, vinyltris(methylethylketoximo)silane, phenyltris(methylethylketoximo)silane, methyltris(diethylketoximo)silane, and tetrakis(methylethylketoximo)silane.

7. A composition according to claim 1, wherein n has an average value of from 500 to 1000.

8. A composition according to claim 1, wherein the olefinic hydrocarbon radicals are selected from the group consisting of vinyl, 5-hexenyl, 7-octenyl, 9-decenyl, and 5,9-decadienyl.

9. A composition according to claim 1, wherein (A) is selected from the group consisting of $ViMe_2SiO(Me_2SiO)_nSiMe_2Vi$,
$HexMe_2SiO(MeHexSiO)_m(Me_2SiO)_nSiMe_2Hex$,
$ViMe_2SiO(MeViSiO)_m(Me_2SiO)_nSiMe_2Vi$,
$HexMe_2SiO(MeHexSiO)_4(Me_2SiO)_{196}SiMe_2Hex$,
$HexMe_2SiO(MeHexSiO)_2(Me_2SiO)_{198}SiMe_2Hex$,
$HexMe_2SiO(MeHexSiO)_3(Me_2SiO)_{151}SiMe_2Hex$, and
$ViMe_2SiO(MeViSiO)_2(Me_2SiO)_{130}SiMe_2Vi$,
$HexMe_2SiO(Me_2SiO)_nSiMe_2Hex$, $PhMeViSiO(Me_2SiO)_nSiPhMeVi$,
$HexMe_2SiO(Me_2SiO)_{130}SiMe_2Hex$, $ViMePhSiO(Me_2SiO)_{145}SiPhMeVi$,
$ViMe_2SiO(Me_2SiO)_{130}SiMe_2Vi$, $ViMe_2SiO(Me_2SiO)_{800}SiMe_2Vi$,
$ViMe_2SiO(Me_2SiO)_{300}SiMe_2Vi$, $ViMe_2SiO(Me_2SiO)_{900}SiMe_2Vi$, wherein Me denotes methyl, Vi denotes vinyl, Hex denotes 5-hexenyl, and Ph denotes phenyl.

10. A composition according to claim 1, wherein (B) is selected from the group consisting of corn starch, carboxy modified polyacrylamides, lithium salts of polymethacrylic acid, zeolite, amino acid containing metal polyoxo-salts, and silicone ionomers.

11. A composition according to claim 10, wherein the silicone ionomer is a sulfate ionomer of aminofunctional siloxane.

12. A composition according to claim 1, wherein (C) is selected from the group consisting of organo compounds of tin, organo compounds of titanium, platinum, and complexes thereof.

13. A composition according to claim 12, wherein (C) is selected from the group consisting of tetrabutyltitanate, stannous octoate, chloroplatinic acid, diisopropoxy-diethylacetoacetate titanate, 2,5-di-isopropoxybis-ethylacetoacetate titanate and titanium bis-(ethyl acetoacetate) diisopropoxy isopropyl alcohol.

14. A composition according to claim 2, wherein the crosslinking agent is an organohydrogensilicon compound.

15. A composition according to claim 14, wherein the organohydrogensilicon compound is selected from the group consisting of bis(trimethylsiloxy)dimethyldihydrogendisiloxane, diphenyldimethyldisiloxane, diphenyltetrakis(dimethylsiloxy)disiloxane, heptamethylhydrogentrisiloxane, hexamethyldihydrogentrisiloxane, methylhydrogencyclosiloxanes, methyltris(dimethylhydrogensiloxy)silane, pentamethylpentahydrogencyclopentasiloxane, pentamethylhydrogendisiloxane, phenyltris(dimethylhydrogensiloxy)silane, polymethylhydrogensiloxane, tetrakis(dimethylhydrogensiloxy)silane, tetramethyltetrahydrogencyclotetrasiloxane, tetramethyldihydrogendisiloxane, and methylhydrogendimethylsiloxanecopolymers.

16. A composition according to claim 3, wherein the inhibitor is selected from the group consisting of maleates, fumarates, aromatic alcohols, and mixtures thereof.

17. A method for the preparation of an electrorheological gel, the method comprising the steps of:

(I) dispersing electrorheologically active solid particles in:

(A) a curable silicone polymer having its formula selected from the group consisting of (i) $(RO)_3SiO(RXSiO)_m(R_2SiO)_nSi(OR)_3$;
(ii) $(RO)_3SiO(RXSiO)_m(R_2SiO)_nSi(X)_3$;
(iii) $(X)_3SiO(RXSiO)_m(R_2SiO)_nSi(X)_3$; and
(iv) mixtures thereof;

wherein R is a monovalent hydrocarbon radical having from 1 to 20 carbon atoms, X is independently selected from the group consisting of R, acyloxy groups, hydroxy groups, alkoxy groups, oxime groups, and olefinic hydrocarbon radicals having from 2 to 20 carbon atoms, m has an average value of from 0 to 100, and n has an average value of from 100 to 2000; and (II) adding (B) a metal catalyst to the mixture of (I); wherein said gel prior to the application of an electric field has a storage modulus of between 500 and 500,000 pascals when measured at a frequency of 10 hertz at 25° C., a peak strain amplitude such that the gel resides in the linear region of viscoelasticity, and has a dynamic mechanical loss tangent of at least 0.5.

18. A method according to claim 17, wherein the method further comprises adding a crosslinking agent after step (I).

19. A method according to claim 17, wherein the method further comprises adding an inhibitor that retards the room temperature curing of a curable mixture of (A), (B), and (C) after step (I).

20. A method according to claim 18, wherein the method further comprises adding an inhibitor that retards the room temperature curing of a curable mixture of (A), (B), and (C) after step (I).

21. A method of using an electrorheological gel composition comprising:

(I) applying an electric field across the electrorheological gel composition, said electrorheological gel composition comprising:

(A) a curable silicone polymer having its formula selected from the group consisting of (i) $(RO)_3SiO(RXSiO)_m(R_2SiO_nSi(OR)_3$;
(ii) $(RO)_3SiO(RXSiO)_m(R_2SiO)_nSi(X)_3$;
(iii) $(X)_3SiO(RXSiO)_m(R_2SiO)_nSi(X)_3$; and
(iv) mixtures thereof;

wherein R is a monovalent hydrocarbon radical having from 1 to 20 carbon atoms, X is independently selected from the group consisting of R, acyloxy groups, hydroxy groups, alkoxy groups, oxime groups, and olefinic hydrocarbon radicals having from 2 to 20 carbon atoms, m has an average value of from 0 to 100, and n has an average value of from 100 to 2,000;

(B) electrorheologically active solid particles; and (C) a metal catalyst;

wherein said gel prior to the application of the electric field has a storage modulus of between 500 and 500,000 pascals when measured at a frequency of 10 hertz at 25° C., a peak strain amplitude such that the gel resides in the linear region of viscoelasticity, and has a dynamic mechanical loss tangent of at least 0.5.

* * * * *